US005291098A

United States Patent [19]

Okita et al.

[11] Patent Number: 5,291,098

[45] Date of Patent: Mar. 1, 1994

[54] LIGHT EMITTING DEVICE

[75] Inventors: Masami Okita; Katsuhiro Akimoto, both of Kanagawa, Japan

[73] Assignee: Sony Corporation, Tokyo, Japan

[21] Appl. No.: 848,124

[22] Filed: Mar. 9, 1992

[30] Foreign Application Priority Data

Mar. 7, 1991 [JP] Japan ..... 3-041809

[51] Int. Cl.[5] ..... H01J 1/54; F21K 2/00

[52] U.S. Cl. ..... 313/506; 313/509; 313/498

[58] Field of Search ..... 313/498, 506, 509

[56] References Cited

U.S. PATENT DOCUMENTS 3,548,214 12/1970 Brown ..... 313/509
4,777,402 10/1988 Mitsumori ..... 313/506
4,876,481 10/1989 Taniguchi et al. ..... 313/506

FOREIGN PATENT DOCUMENTS 50-40913 12/1975 Japan ..... 313/506

*Primary Examiner*—Donald J. Yusko
*Assistant Examiner*—Nimesh D. Patel
*Attorney, Agent, or Firm*—Hill, Steadman & Simpson

[57] ABSTRACT

A light emitting device has a transparent substrate, a substantially transparent first electrode layer formed on the transparent substrate, a phosphor layer formed on the first electrode layer, a second electrode layer formed on the phosphor layer, an insulating layer formed on the second electrode layer, and a third electrode layer formed on the insulating layer. A hot electron is generated by the application of a voltage to the second and third electrode layers, and the light emitting device is energized to become luminuous by injecting the hot electron thus generated into the phosphor layer.

5 Claims, 1 Drawing Sheet

LIGHT EMITTING DEVICE

BACKGROUND OF THE INVENTION

1. Field of the Invention

The present invention generally relates to thin film light emitting devices and, more particularly, is directed to a thin film light emitting device for use with a thin film color display apparatus or the like.

2. Description of the Related Art

As a thin film light emitting device, the development of an electroluminescence (EL) devices has been advanced so far. The conventional EL device has electrodes formed on both surfaces of a phosphor thin film and a voltage is applied to these electrodes to thereby make the phosphor become luminous.

A principle of so-called electric field radiation is considered as follows:

An electric field whose magnitude is large in the thickness direction of the phosphor thin film, e.g., electric field of about $10^6$V/cm is generated in the phosphor thin film by the voltage applied to these electrodes. By this electric field thus generated, electrons of surface level of phosphoror of impurity level are emitted by a so-called tunnel effect to the conduction band. Further, hot electrons are generated by an acceleration of the electric field and the hot electrons strike radiation centers in the phosphor, whereby the radiation centers are set in an excited state by the reception of energy. Then, when the radiation centers return to a ground state, photons are emitted.

In such electric field radiation, when ZnS is employed as a host crystal of phosphor, efficient radiation is obtained in the radiation center of internal transition type such as the radiation center of Mn or rare-earth materials.

However, bright radiation is not obtained in the radiation center of donor acceptor pair type such as ZnS : Cu, Al or ZnS : Ag, Al which demonstrate high radiation efficiency by the excitation of electron beam.

Accordingly, in this kind of electric field radition type thin film light emitting device, light emitting elements of various colors, particularly a blue light emitting element cannot be obtained without difficulty in the prior art, which becomes a bottleneck in the application of this kind of thin film light emitting device to a thin film color video display apparatus.

OBJECTS AND SUMMARY OF THE INVENTION

Therefore, it is an object of the present invention to provide an improved light emitting device in which the aforesaid shortcomings and disadvantages encountered with the prior art can be eliminated.

More specifically, it is an object of the present invention to provide a light emitting device in which a high radiation efficiency can be obtained by the use of an electric field driving mode for a phosphor having donor acceptor pair type radiation centers.

It is another object of the present invention to provide a light emitting device which can be suitably applied to a thin film color display apparatus.

According to an aspect of the present invention, a light emitting device is comprised of a transparent substrate, a substantially transparent first electrode layer formed on the transparent substrate, a phosphor layer formed on the first electrode layer, a second electrode layer formed on the phosphor layer, an insulating layer formed on the second electrode layer, and a third electrode layer formed on the insulating layer, wherein a hot electron is generated by the application of a voltage to the second and third electrode layers and the light emitting device is energized to become luminuous by injecting the hot electron thus generated into the phosphor layer.

The above and other objects, features, and advantages of the present invention will become apparent from the following detailed description of an illustrative embodiment thereof, in conjunction with the accompanying drawing.

DESCRIPTION OF THE PREFERRED EMBODIMENT

Figure 1:
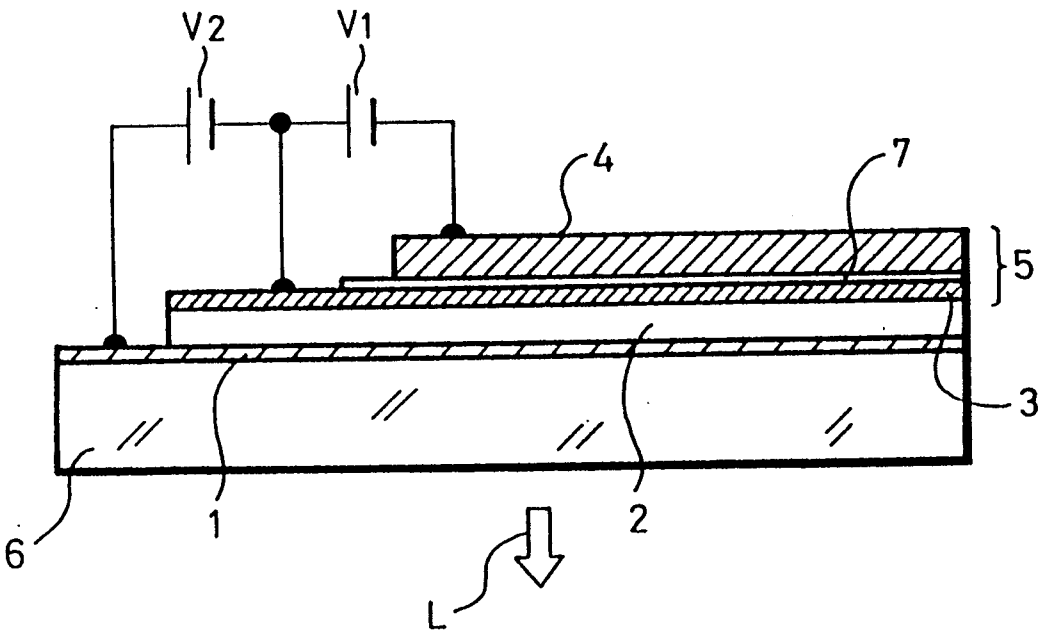
FIG. 1 a cross-sectional view illustrating a structure of a thin film light emitting device according to an embodiment of the present invention.

A thin film light emitting device according to an embodiment of the present invention will hereinafter be described with reference to FIG. 1.

In this embodiment, as shown in FIG. 1, a transparent conductive layer or the like made of ITO (indium tin oxide) or the like is deposited on a transparent substrate 6 formed of a glass substrate or the like, thereby forming a first electrode layer 1.

A phosphor layer 2 is coated on the first electrode layer 1 by some suitable process, such as an MBE (molecular beam epitaxy) process or the like. Then, a second electrode layer 3 made of Al, Au or the like is deposited on the phosphor layer 2 by the vapor deposition process or the like. A thickness of the second electrode layer 3 is selected to fall in a range of more than several 10s of angstroms to less than several 100s of angstroms ($10<$thickness $<100$s) so that the second electrode layer 2 can function as an electrode.

Further, a thin film insulating layer 7 is formed on the second electrode layer 3 by the vapor deposition process or the like. Alternatively, when the second electrode layer 3 is made of Al or the like, the surface of the second electrode layer 3 is oxidized to form the thin film insulating layer 7 made of $Al_2O_3$ having a thickness of about several 10s of angstroms which forms a tunnel junction. Then, a third electrode layer 4 made of Al, Au or the like is formed on the thin film insulating layer 7 by the vapor deposition process, the sputtering process or the like.

As the phosphor layer 2, it is possible to use such phosphor in which ZnS, for example, is a host crystal and a radiation center is an internal transition radiation center of rare-earth material. Particularly in the present invention, a phosphor layer based on the radiation center of donor acceptor pair type such as ZnS : Cu, Al or ZnS : Ag, Al, i.e., various kinds of conventional phosphors, i.e., phosphors of respective colors used as phosphors which emit light by the electron beam excitation such as ZnS : Cu, Al, ZnS : Ag, Al or the like can be employed.

In the first and second electrode layers 1 and 3, respective layers are formed in a limited fashion or removed by the etching process, thereby one portion of these layers being exposed to the surface. Then, terminals are led out from the first and second electrode layers 1 and 3, respectively. A voltage $V_1$ of about ten-odd Volts is applied between the third and second electrode layers 4 and 3 and a voltage $V_2$ of about ten-odd Volts is applied between the second and first electrode layers 3 and 1.

Thus, a hot electron generating means 5 is constructed between the third and second electrode layers 4 and 3 via the thin film insulating layer 7.

According to the light emitting device thus arranged, when the voltage is applied to the third and second electrodes 4 and 3, a current is flowed due to the tunnel effect of the thin film insulating layer 7 and a hot electron having energy $eV_1$ corresponding to this potential difference $V_1$ is generated within the second electrode layer 3. Because the thickness of the second electrode layer 3 is sufficiently thin, this hot electron reaches the interface between the second electrode layer 3 and the phosphor layer 2 while maintaining the energy $eV_1$.

Further, this hot electron is injected into the phosphor layer 2 by the electric field brought about by the bias voltage $V_2$ applied between the second and first electrodes 3 and 1. At that time, if the phosphor layer 2 is the donor acceptor pair type phosphor, by selecting the energy of the voltages $V_1$ and $V_2$ given to the hot electron and the magnitude of the electric field given to the phosphor layer, the energy of the hot electron is set to exceed a threshold value of an electron hole pair generation, whereby the radiation can be efficiently carried out even in the donor acceptor pair type phosphor. Thus, a radiation L can be observed from the transparent substrate 6 side.

As described above, according to the present invention, since the donor acceptor pair type phosphor, i.e., various kinds of phosphors used in the electron beam radiation as in a phosphor screen of an ordinary cathode ray tube can be constructed as a thin film light emitting device, a thin film display apparatus can be constructed by using such phosphors as various kinds of display elements, e.g., pixels of red R, green G and blue B. Further, since sufficiently high light emitting efficiency can be obtained, a bright light emitting display apparatus can be obtained.

Further, since the light emitting device of this invention has the structure such that the respective electrode layers and the phosphor layers are sequentially laminated on the substrate, the standard thin film technique can be applied to the thin film light emitting device of the present invention. Therefore, it is possible to produce a thin film light emitting device which is excellent in mass-production and also in fine patterning technique. Furthermore, the thin film light emitting display apparatus can be constructed by using the above thin film light emitting device.

Having described the preferred embodiment of the invention with reference to the accompanying drawing, it is to be understood that the invention is not limited to that precise embodiment and that various changes and modifications thereof could be effected by one skilled in the art without departing from the spirit or scope of the invention as defined in the appended claims.

What is claimed is:

1. A light emitting device comprising:

(a) a transparent substrate;

(b) a substantially transparent first electrode layer formed on said transparent substrate;

(c) a phosphor layer formed on said first electrode layer;

(d) a second electrode layer formed on said phosphor layer;

(e) an insulating layer formed on said second electrode layer; and (f) a third electrode layer formed on said insulating layer, wherein a hot electron is generated by the application of a voltage to said second and third electrode layers and said light emitting device is energized to become luminuous by injecting said hot electron thus generated into said phosphor layer.

2. A light emitting device according to claim 1, in which said phosphor layer is formed of a phosphor whose radiation center is a donor acceptor pair type radiation center.

3. A light emitting device according to claim 1, in which a thickness of said second electrode layer is set in a range of from 10 Å to 100 Å and a thickness of said insulating layer formed on said second electrode layer is set to about several 10s of angstroms.

4. A light emitting device according to claim 1, in which said second electrode layer is made of aluminum (Al) and said insulating layer formed on said second electrode layer is made of aluminum oxide which results from oxidizing said second electrode layer.

5. A light emitting device according to claim 1, in which voltages applied to said first, second and third electrodes are set in such a fashion that an energy of said hot electron generated exceeds a threshold value of electron hole pair generation of said phosphor.

* * * * *